US006609462B2

(12) United States Patent
Hauck

(10) Patent No.: US 6,609,462 B2
(45) Date of Patent: Aug. 26, 2003

(54) METHOD AND DEVICE FOR CONTROLLING A TRANSFER REGISTER IN A SHEET-FED ROTARY PRINTING MACHINE

(75) Inventor: Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/903,358

(22) Filed: Jul. 11, 2001

(65) Prior Publication Data

US 2003/0010242 A1 Jan. 16, 2003

(30) Foreign Application Priority Data

Jul. 11, 2001 (DE) ..... 100 33 584

(51) Int. Cl.[7] ..... B41F 33/00; B41F 5/16; B41M 1/14

(52) U.S. Cl. ..... 101/484; 101/171; 101/181; 101/211; 101/483

(58) Field of Search ..... 101/484, 211, 101/171, 181, 483

(56) References Cited

U.S. PATENT DOCUMENTS

| | | | | |
|---|---|---|---|---|
| 5,036,764 A | | 8/1991 | Rodi | |
| 5,524,538 A | * | 6/1996 | Voge et al. | 101/142 |
| 5,806,430 A | * | 9/1998 | Rodi | 101/484 |
| 6,050,192 A | * | 4/2000 | Kipphan et al. | 101/232 |
| 6,119,594 A | * | 9/2000 | Kipphan et al. | 101/365 |

FOREIGN PATENT DOCUMENTS

| | | | | |
|---|---|---|---|---|
| DE | 31 48 449 C1 | | 6/1983 | |
| DE | 44 34 843 A1 | | 4/1996 | |
| EP | 0 513 284 B1 | | 11/1992 | |
| JP | 09277494 A | * | 10/1997 | B41F/33/14 |
| JP | 2000225689 A | * | 8/2000 | B41F/33/14 |

OTHER PUBLICATIONS

Translation of previously cited JP 09–277494 A to Iwahashi et al.*

* cited by examiner

*Primary Examiner*—Charles H. Nolan, Jr.
(74) *Attorney, Agent, or Firm*—Laurence A. Greenberg; Werner H. Stemer; Ralph E. Locher

(57) ABSTRACT

A method of avoiding register differences during the operation of a printing machine having a plurality of individual printing units includes counteracting, at least by circumferential register corrections, respective register differences in the individual printing units, determining the register differences for different printing speeds and storing them in a memory, and determining the various register differences at different printing speeds by an automatic register measuring and register control device and, in the event of changes in the printing speed, superimposing the previously determined magnitude of the register correction on the adjusted variable of the automatic register measuring and register control device; and a device for performing the method.

7 Claims, 4 Drawing Sheets

PRIOR ART

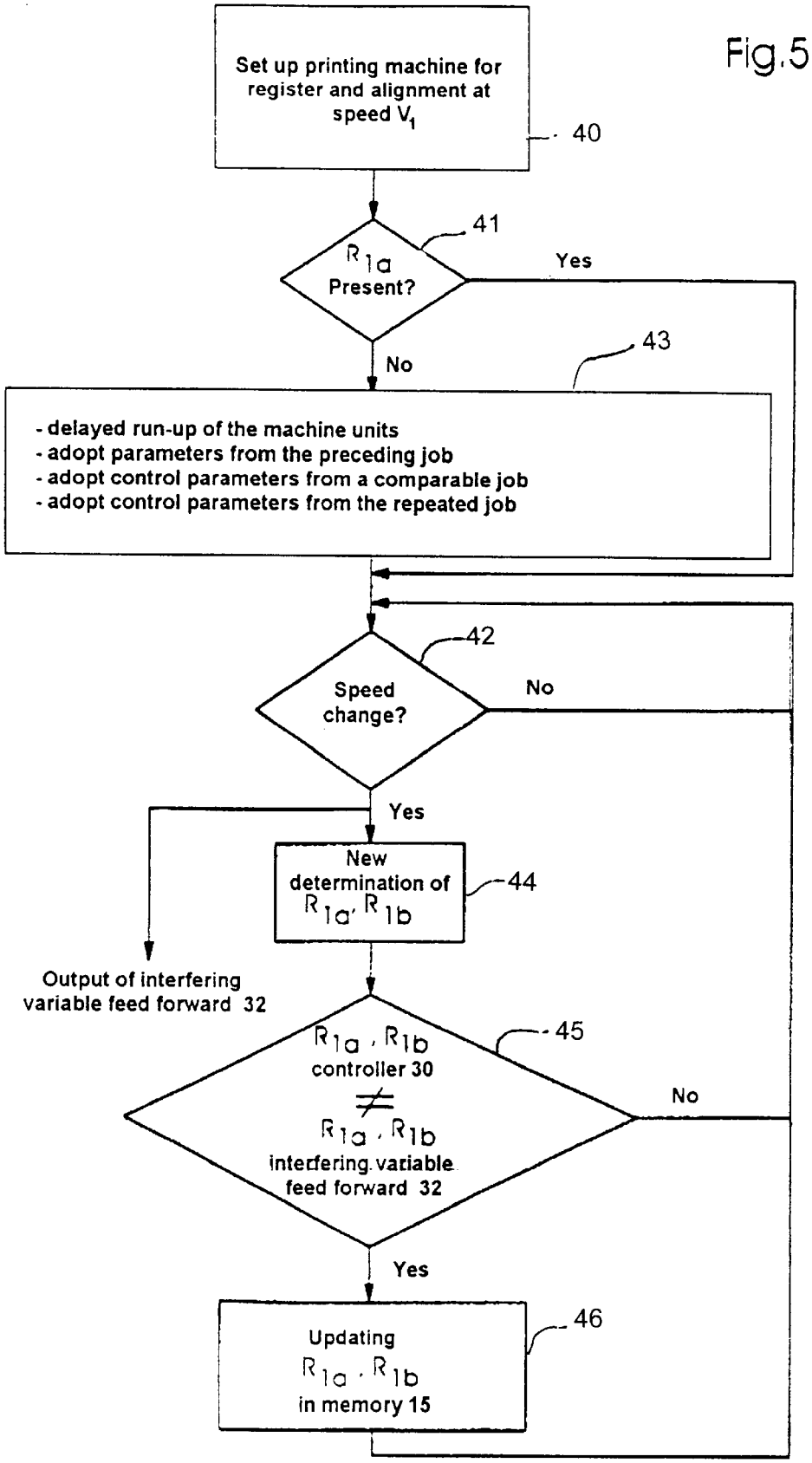
Fig.5
Set up printing machine for register and alignment at speed $V_1$
40
$R_{1a}$ Present?
41
Yes
No
43
- delayed run-up of the machine units
- adopt parameters from the preceding job
- adopt control parameters from a comparable job
- adopt control parameters from the repeated job
Speed change?
42
No
Yes
New determination of $R_{1a}$, $R_{1b}$
44
Output of interfering variable feed forward 32
$R_{1a}$, $R_{1b}$ controller 30 ≠ $R_{1a}$, $R_{1b}$ interfering variable feed forward 32
45
No
Yes
Updating $R_{1a}$, $R_{1b}$ in memory 15
46

METHOD AND DEVICE FOR CONTROLLING A TRANSFER REGISTER IN A SHEET-FED ROTARY PRINTING MACHINE

BACKGROUND OF THE INVENTION

FIELD OF THE INVENTION

The invention relates to a method and a device for controlling a transfer register in a sheet-fed rotary printing machine.

Modern sheet-fed offset printing machines attain printing speeds of 15,000 and more sheets per hour and, based upon the dc-drives which are used, can be operated over a wide rotational-speed range.

Regardless of the printing speed, positional accuracy of color separations relative to one another is an essential precondition for achieving good printing quality. This positional accuracy is characterized by the transfer register.

For evaluation or assessment, a distinction is drawn between the circumferential and lateral directions. A faulty position of color separations relative to one another can have an effect upon the appearance of the print color, in particular, in multicolor half-tone, and upon sharpness of detail. In addition, ghosting phenomena can result from a succession of fluctuations in the transfer register during the printing process.

The transfer register is influenced by a great number of factors, which can be divided mainly into dynamic and static influences. In addition to printing speed, one of the most significant factors, the transfer of sheets from the paper-quiding cylinders, and sheet displacements in the grippers, which can be viewed as dynamic influences, there are yet many other speed-independent factors which include the position of color separations on the printing plates and the position of the plates on the plate cylinders. In addition, the temperature in the individual printing units, the subject, as well as the viscosity of the ink have an influence upon the transfer register.

In order to keep the transfer register constant, i.e., to avoid register differences, a great deal of effort is expended with regard to construction. For example, improving the rigidity of the gear train is a measure to be included therein. All the measures in this regard, in addition to the outlay for construction, have the further disadvantage that physical limits make a compensation measure inevitable. For example, each change in the printing speed from a basic rotational speed to continuous or production-printing rotational speed generally entails register differences. These are based mainly on three primary influencing factors.

First, because of the rotational speed-dependent load torque of the individual printing units, torsion, which depends upon the rotational speed, occurs in the mechanical drive train of the machine. Furthermore, changes in the pull-off or withdrawal forces on the sheets, and the change in the drive power caused by the heating of the individual printing units because of deformations in the gear train have an influence upon the transfer register. However, the influence of rapid changes, for example, of the rotational speed, is greatest with regard to ghosting.

In order to be able to correct the occurring register differences, remotely adjustable devices for register adjustment are provided in the individual printing units in modern printing machines. For the purpose of correcting in the circumferential direction, and in the lateral direction, and for making a diagonal adjustment, the plate cylinders, in particular, can be constructed so that they are remotely adjustable with respect to the blanket cylinders cooperating therewith.

The prior art discloses an automatic register measuring and control device of the firm Heidelberger Druckmaschinen AG of Heidelberg, Germany, having the designation CPC-42, referred to hereinafter as Autoregister, wherein, in each printing unit, measuring marks which describe the position of the color separation on the paper sheet are printed at the sheet edges. The register differences are then compensated for by the fact that, by using these printed register marks or the like, the register differences of the individual partial colors relative to one another are determined, and serve for calculating actuating commands for required register corrections, and the latter are used for adjusting. In order for the individual partial colors to come into coincidence again with the correct position, the position of the individual plate cylinders in the printing units is corrected, in particular for the circumferential and lateral register. Before the register marks can be read-in at the last printing unit, and existing register differences can be corrected by the Autoregister, some sheets have already been transported through the printing machine. In the case of a ten-color printing machine, 27 sheets have already been printed before the distances between the various marks have been read-in and processed.

It is precisely in the phases during which acceleration or braking of the printing machine takes place that the Autoregister control cannot react optimally because of the circumstances mentioned at the introduction hereto.

In order to counteract this problem, the published European Patent Document EP 0 513 284 B1 proposes that the dynamic states, i.e., acceleration and braking, be detected during the printing job by an acceleration detecting device and, at the same time, that the automatic register control be switched off.

In addition, the published German Patent Document DE 44 34 843 A1 discloses a control system which, by using previously determined empirical values, represents the speed-dependent changes in the transfer register of the individual printing units relative to one another, and deposits them in a family of characteristic curves. For each individual printing unit, one such characteristic curve is determined which specifies how large the correction to be performed in the circumferential register has to be in order just to correct the register difference in the circumferential direction caused by the printing unit under consideration. A great number of trials is required in order to determine such characteristic curves, which are then stored in a control system. The quality of the results, therefore, depends upon the quality of these stored characteristic curves and, in particular, upon the question as to the extent to which it is possible to describe complex reality in the manner of a model by using such a characteristic curve. Situations are easy to imagine wherein, nevertheless, rejects will accumulate to a considerable extent, because the characteristic curve does not exactly represent the behavior of the machine.

SUMMARY OF THE INVENTION

Starting from the aforementioned prior art, it is an object of the invention to provide a method and a device for controlling a transfer register in a sheet-fed rotary printing machine by which the number of rejects occurring during changes in the printing speed is considerably reduced and, at the same time, to aid the pressman in arriving more quickly at a good sheet.

With the foregoing and other objects in view, there is provided, in accordance with one aspect of the invention, a method of avoiding register differences during the operation of a printing machine having a plurality of individual printing units, which comprises counteracting, at least by circumferential register corrections, respective register differences in the individual printing units, determining the register differences for different printing speeds and storing them in a memory, and determining the various register differences at different printing speeds by an automatic register measuring and register control device and, in the event of changes in the printing speed, superimposing the previously determined magnitude of the register correction on an adjusted variable of the automatic register measuring and register control device.

In accordance with another mode, the method of the invention includes calculating in a central control device corrections dependent upon printing speed, which are required to compensate for register differences.

In accordance with a further mode, the method of the invention includes performing the calculation required to compensate for register differences based upon values which have been determined automatically by an automatic register measuring and register control device.

In accordance with an added mode, the method of the invention includes compensating for the register differences by the register adjusting devices based upon the values stored in the memory and as a function of the printing speed.

In accordance with an additional mode, the method of the invention includes compensating for the register differences by the register adjusting devices based upon the values stored in the memory and as a function of acceleration.

In accordance with yet another mode, the method of the invention includes additionally taking the temperature in the individual printing units into account as a parameter of the register correction.

In accordance with another aspect of the invention, there is provided a device for avoiding register differences during the operation of a printing machine having a plurality of individual printing units, comprising a device for counteracting, at least by circumferential register corrections, respective register differences in the printing units, and a device for determining the register differences for different printing speeds and storing them in a memory, and an automatic register measuring and register control device for determining the various register differences at different printing speeds and, in the event of changes in the printing speed, superimposing the previously determined magnitude of the register correction on an adjusted variable of the automatic register measuring and register control device.

In accordance with a concomitant aspect of the invention, there is provided a device for avoiding register differences during operation of a printing machine having a plurality of printing units, the register differences occurring at different printing speeds, comprising an automatic register measuring and register control device for automatically determining values of the register differences occurring at different printing speeds, and for calculating requisite register corrections therefrom, the values of which are feedable forward to adjusted variables of the register measuring and register control device as a function of the printing speed during printing operation, the calculated register corrections being continually checkable by the automatic register measuring and register control device and, if necessary, being recorrectable, and including a memory for storing data determined in this manner for later availability.

The change in the printing speed is thus registered by measurement technology, and a previously determined magnitude of the register correction which depends upon the speed is fed forward to the automatic register control device as an interfering or disturbance variable. This measure places the control device in a position to react very rapidly with the change, so that, as a result, the number of rejects are reduced.

Because a printing machine already has a high-resolution incremental encoder available for detecting angular position or rotational speed, the signals supplied by the encoder can be used for implementing the method according to the invention. Register correction values, which are used for interfering or disturbance-variable feed forward, are stored in a storage device or memory. A computing device then reads the correction values from the memory as a function, for example, of the rotational speed or the acceleration of the printing machine, and feeds these forward to the register control device as interfering or disturbance-variable feed forward. The computing device is also capable of using interpolation or extrapolation to calculate correction values which lie inside or outside values which are stored in the memory.

This combination of computing unit and memory in principle permits four different method sequences. If no data to which the central control device could refer back are available in the memory, the printing machine is run up slowly, during which time parameterization takes place. As a result of the printing machine being run up slowly, the automatic register control device is able to perform a correction without having rejects produced in the process. The values determined in this manner are then stored in a memory and are available to the interfering or disturbance-variable feed forward for future rotational speed changes. Then, with the aid of a suitable program, the values of the register offset determined by the register measuring device can be used to interpolate or extrapolate the requisite values for the interfering or disturbance-variable feed forward. Because they are stored in the memory, these data are now available for register corrections.

First, the parameters from the preceding job can be taken from the memory. However, the control parameters of a comparable job, for example with an average area coverage, can also be taken from the memory and evaluated.

Finally, it may happen that the same print job is performed again. In the case of such a repeat job, it is possible again to use the data predetermined earlier.

Although, hereinbefore, only the printing speed was mentioned as a parameter for the interfering or disturbance-variable feed forward, it is conceivable to register further parameters and to take them into account in the program that calculates the interfering or disturbance variables. It would be possible to imagine detecting the acceleration or measuring the temperature in the individual printing units and evaluating them in the central control device. For example, as in the case of the printing speed, depending upon the temperature, the requisite register correction can be stored in a memory and then used for interfering or disturbance-variable feed forward. In general, the register errors which are caused by temperature changes are very slow and can normally be compensated for by the automatic register control device without production of rejects at the same time. However, it would also be conceivable to bring the values determined here into use in printing machines which do not have automatic register control.

Other features which are considered as characteristic for the invention are set forth in the appended claims.

Although the invention is illustrated and described herein as embodied in a method and device for controlling a transfer register in a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 5 is a flow chart of a program running in an interfering or disturbance-variable feed-forward system 32 forming part of the control device 13 according to FIG. 4.

DESCRIPTION OF THE PREFERRED EMBODIMENTS

Figure 1:
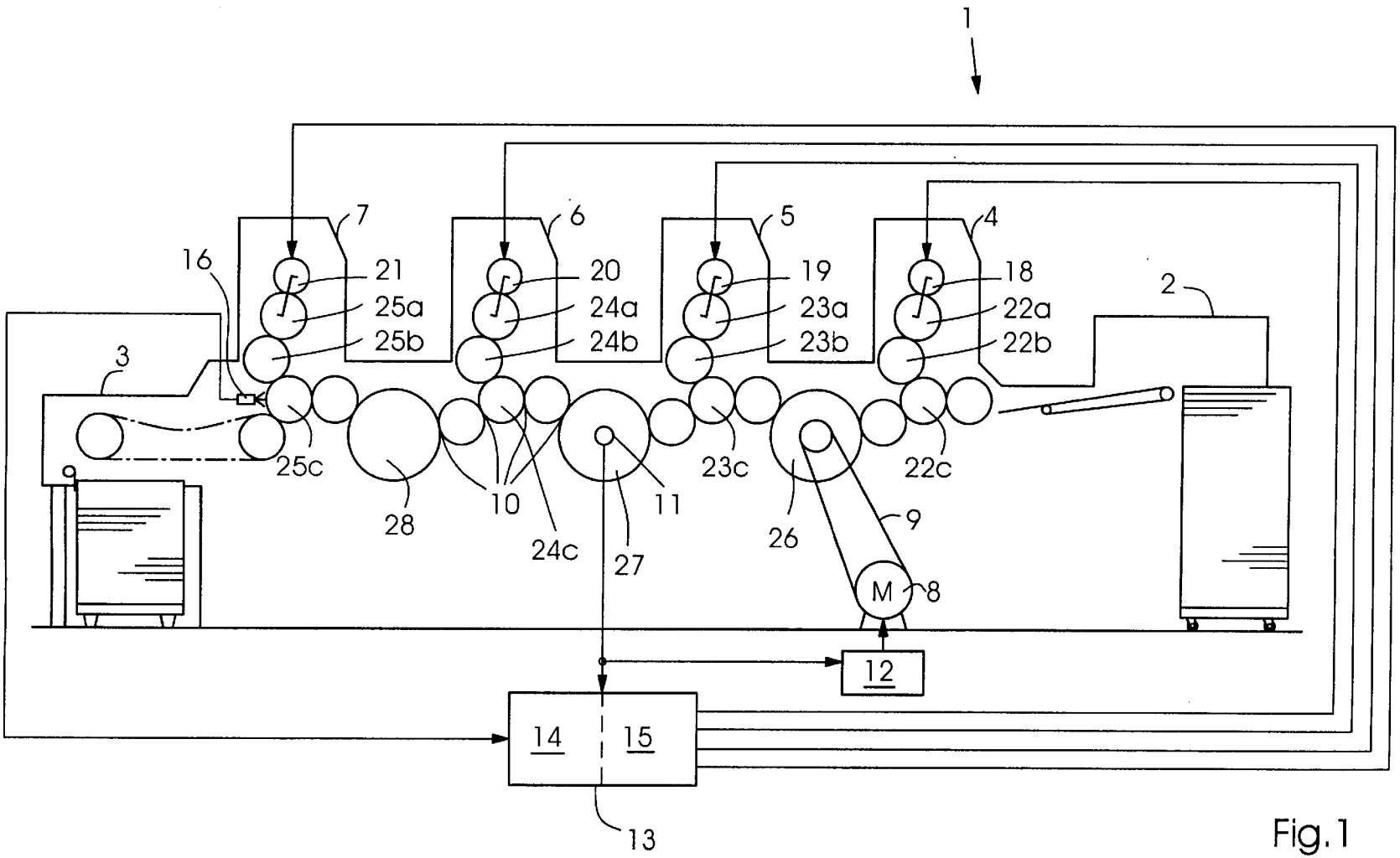
FIG. 1 is a simplified basic diagrammatic and schematic side elevational view of a sheet-fed offset printing machine incorporating the invention of the instant application.

Referring now to the drawings and, first, particularly to FIG. 1 thereof, there is shown therein a four-color sheet-fed offset printing machine 1, which has a feeder 2 and a delivery 3. The printing machine includes four printing units 4, 5, 6 and 7 and a drive motor 8 which, by a belt 9, drives a gear train 10 of all four of the printing units 4, 5, 6 and 7 and the feeder 2, as well as the delivery 3.

Printing form or plate cylinders 22*a*, 23*a*, 24*a* and 25*a* of the four printing units 4, 5, 6 and 7 are operatively associated with respective blanket cylinders 22*b*, 23*b*, 24*b* and 25*b*, and with respective impression cylinders 22*c*, 23*c*, 24*c* and 25*c*. The sheets to be printed run through the printing machine between the blanket cylinders 22*b*, 23*b*, 24*b* and 25*b*, on the one hand, and the impression cylinders 22*c*, 23*c*, 24*c* and 25*c*, on the other hand.

A then-current printing speed is picked off between the printing units by an incremental encoder 11 on one of three transfer cylinders 26, 27 or 28 and fed to a motor controller 12, which is connected to the drive motor 8.

The values from the incremental encoder 11 are also additionally fed into a central control device 13, which includes a computing unit 14 and a memory 15.

In the last printing unit 7 of the printing machine 1, a sensor strip 16 is disposed opposite the impression cylinder 25*c*. This sensor strip 16 registers and evaluates printed register marks and supplies the read-in data to the computing unit 14. Based upon the data which the computing unit 14 receives from the incremental encoder 11 and the sensor strip 16, and based upon data stored in a memory 15, the central control device 13 then calculates corrections which are used for adjusting the corresponding plate cylinders 22*a*, 23*a*, 24*a* and 25*a* via register adjusting motors 18, 19, 20 and 21 of the individual printing units 4, 5, 6 and 7. Data which represent the dependence of register adjustment values on various influencing variables are stored in the memory 15. These may be, for example, the rotational speed, the acceleration, the temperature, the subject, the viscosity of the ink, and so forth.

Using the data stored in the memory 15 of the central control device 13, and the change in the printing speed reported by the incremental encoder 11, the computing unit 14 applies a specific algorithm to calculate appropriate register compensations, which act upon the plate cylinders 22*a*, 23*a*, 24*a* and 25*a* via the register adjusting motors 18, 19, 20 and 21.

Figure 2:
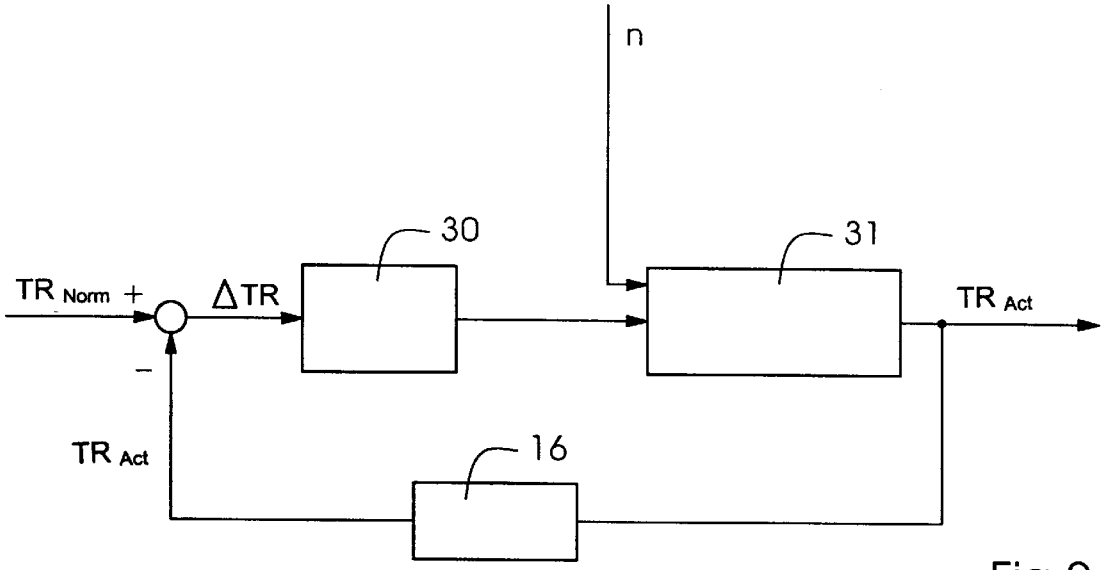
FIG. 2 is a schematic block diagram of an automatic register measuring and register control device according to the prior art.

FIG. 2 shows, as prior art, an automatic register measuring and register control device which is currently a constituent part of many modern printing machines. An interfering or disturbance variable n, in this case a change in the printing speed, has a negative effect upon the controlled system 31 of the printing machine. The reference variable assumed here is the transfer register $TR_{ACT}$. As the sheet passes through the individual printing units of the printing machine, register marks are printed at the edge of the sheets. In the last printing unit, these register marks are evaluated by the sensor strip 16, and the register difference ΔTR is fed to the controller 30. The latter then regulates the register difference out, by outputting appropriate actuating variables to the register adjusting motors 18, 19, 20 and 21 to compensate for the register error. Via the mechanics of the printing machine, which is part of the controlled system 31, a new, corrected transfer register TR is then established. This changed and improved transfer register is "seen" by the sensor strip 16 only when the paper sheet printed with the appropriately shifted register marks has passed into the last printing unit 7.

This type of control therefore has a dead-time and delay response, wherein there is a relatively long time period before the controller 30 can react to the change in an interfering or disturbance variable.

Figure 3:
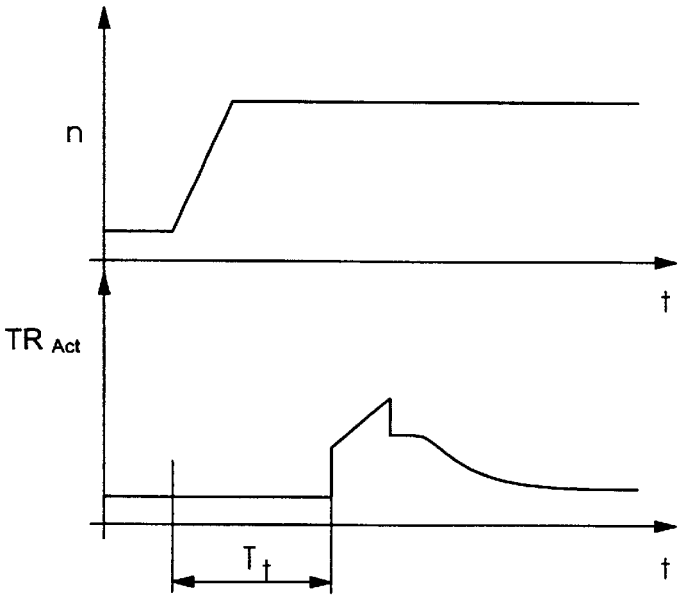
FIG. 3 is a graph showing the delay response of the heretofore known register control device according to FIG. 2.

FIG. 3 illustrates the delay response. In this regard, the graph at the top of the figure represents the dependence of the rotational speed n, which acts here upon the system as an interfering or disturbance variable, as a function of the time t. It is quite apparent that n changes from a low value to a high value. This could represent, for example, the set-up rotational speed and the continuous printing or production-run rotational speed. In the lower graph, the transfer register TR is represented as a function of t. Only after a dead time $T_t$ are changes in the controlled variable TR based upon a changed speed and/or based upon the acceleration noticed by the sensor strip 16, and a control operation initiated. This dead time causes rejects, the number of which is higher, the greater the length of the machine, i.e., the greater the number of printing units. These rejects are reduced as a result of the method according to the invention.

Figure 4:
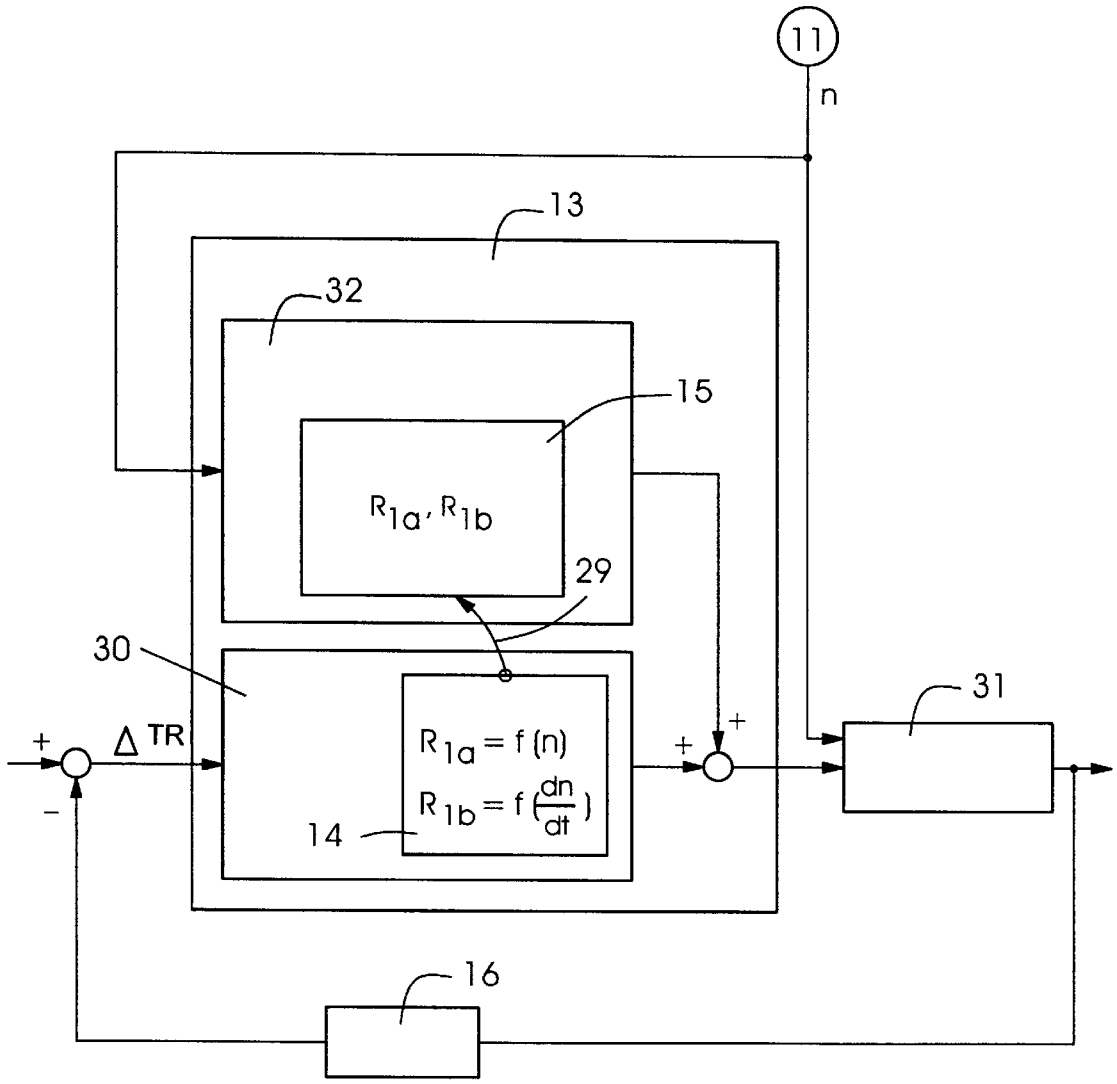
FIG. 4 is a schematic block diagram of an automatic register measuring and control device according to the invention of the instant application.

FIG. 4 shows the control device 13 according to the invention. In addition to the controller 30 already known from FIG. 2, an interfering or disturbance-variable feed forward system 32 is provided. This includes a memory 15 for control parameters R1*a* and R1*b*, of which R1*a* represents the speed-dependent portion of the controlled variable, and R1*b* represents the portion of the controlled variable due to the acceleration. The controller 30 and the interfering or disturbance-variable feed forward system 32 together form an overall control device 13. If the interfering or disturbance variable n then changes, a condition which is determined by the incremental encoder 11, the resulting value is communicated to the interfering or disturbance-variable feed forward system 32 as well. Depending upon the magnitude of the interfering or disturbance variable, the control parameters stored in the memory 15 are determined and added to the adjusted variable of the controller 30. The controlled system 31 therefore initially receives, virtually simultaneously, the speed change n (the interfering or disturbance variable) and, then, an adjusted variable for the register adjusting motors 18, 19, 20 and 21. Depending upon the quality of the control parameters which are output by the interfering or disturbance variable feed forward system 32, the task of the controller 30 then only is to regulate out the fine transfer register differences.

Provided in the controller 30 is a computing unit 14, which continuously redetermines the control parameters R1*a* and R1*b* during speed changes, and communicates them to the memory 15 of the interfering or disturbance variable feed forward system 32. This is represented by the arrow 29. The advantage of this procedure is in that temperature drift, which can have an effect upon the transfer register response of a printing machine, is taken into account. In practical terms, this means that the controller 30 corrects the transfer register through the intermediary of the register adjusting motors 18, 19, 20 and 21 without any change being performed by the interfering or disturbance-variable feed forward system 32, because there is no rotational speed change.

FIG. 5 describes a program running in the central control device 13 by using a flow diagram. At a specific printing speed V1, the printing machine is set up at 40 with regard to register and alignment. The central control device 13 checks at 41 whether the control parameters R1*a* are present and available. If this is the case, a further check is made at 42 as to whether a speed change has taken place. If R1*a*, R1*b* are not present, then, in principle, there are four possibilities available to the system, as shown at 43:

1. a parameterization of the controller can be performed by a delayed run-up of the machine,
2. the parameters from the preceding job can be used,
3. an examination is made to determine whether control parameters from a comparable job are present, or
4. a check is made to determine whether this is, in fact, a repeated job.

This ensures that the system has the control parameters R1*a*, R1*b* available. If speed changes then take place, i.e., if the interfering or disturbance variable changes, then new values for R1*a* and R1*b* are determined at 44 and 45, and output. R1*b* is the portion of the controlled variable due to acceleration, it being possible for the acceleration to be calculated from the speed change. The new value for R1*a*, the speed-dependent portion of the controlled variable, at 46 is either available in the memory for the new condition or is interpolated or extrapolated based upon the values stored in the memory.

I claim:

1. A method of avoiding register differences during the operation of a printing machine having a plurality of individual printing units, which comprises:

counteracting, at least by circumferential register corrections, respective register differences (ΔTR) in the individual printing units;

determining control parameters (R1*a*,R1*b*) for different printing speeds and storing them in a memory, the control parameters including a speed-dependent portion and an acceleration-dependent portion;

determining the register differences (ΔTR) at different printing speeds by an automatic register measuring and register control device;

measuring an interfering or disturbance variable (n) and forwarding it simultaneously to a controlled system and an interfering or disturbance-variable feed forward system; and in the event of changes in the printing speed, superimposing the previously determined magnitude of the control parameters (R1*a*,R1*b*) on the register differences (ΔTR) of the automatic register measuring and register control device.

2. The method according to claim 1, which includes calculating in a central control device corrections dependent upon printing speed, which are required to compensate for register differences.

3. The method according to claim 1, which includes performing the calculation required to compensate for register differences based upon values which have been determined automatically by the automatic register measuring and register control device.

4. The method according to claim 1, which includes compensating for the register differences by the register adjusting devices based upon the values stored in the memory and as a function of the printing speed.

5. The method according to claim 1, which includes compensating for the register differences by the register adjusting devices based upon the values stored in the memory and as a function of acceleration.

6. The method according to claim 1, which includes additionally taking the temperature in the individual printing units into account as a parameter of the register correction.

7. A device for avoiding register differences during the operation of a printing machine having a plurality of individual printing units, comprising:

a controlled device for counteracting, at least by circumferential register corrections, respective register differences (ΔTR) in the printing units;

an interfering or disturbance-variable feed forward system having a memory;

a device for determining control parameters (R1*a*,R1*b*) for different printing speeds and storing them in said memory, the control parameters including a speed-dependent portion and an acceleration-dependent portion;

a device for measuring an interfering or disturbance variable (n) and forwarding the interfering or disturbance variable simultaneously to said controlled device and said interfering or disturbance-variable feed forward system; and an automatic register measuring and register control device for determining the register differences (ΔTR) at different printing speeds and, in the event of changes in the printing speed, superimposing the previously determined magnitude of the control parameters (R1*a*,R1*b*) on the register differences (ΔTR) said automatic register measuring and register control device.

* * * * *